US008596643B1

(12) United States Patent
Edwards

(10) Patent No.: US 8,596,643 B1
(45) Date of Patent: Dec. 3, 2013

(54) IMPACT MARKING TARGET BLANK AND METHOD FOR MANUFACTURING, MARKETING AND USING SAME

(71) Applicant: A. W. Edwards, Bonita Springs, FL (US)

(72) Inventor: A. W. Edwards, Bonita Springs, FL (US)

( * ) Notice: Subject to any disclaimer, the term of this patent is extended or adjusted under 35 U.S.C. 154(b) by 0 days.

(21) Appl. No.: 13/724,577

(22) Filed: Dec. 21, 2012

Related U.S. Application Data

(63) Continuation-in-part of application No. 13/065,005, filed on Mar. 11, 2011, now abandoned.

(60) Provisional application No. 61/398,878, filed on Jul. 2, 2010.

(51) Int. Cl.
*F41J 5/00* (2006.01)

(52) U.S. Cl.
USPC ..... 273/378

(58) Field of Classification Search
USPC ..... 273/378, 380, 403–410; 101/401.1
See application file for complete search history.

(56) References Cited

U.S. PATENT DOCUMENTS

| | | | | | |
|---|---|---|---|---|---|
| 1,093,171 | A * | 4/1914 | Buell | 273/378 |
| 3,423,092 | A * | 1/1969 | Kandel | 273/378 |
| 3,895,803 | A * | 7/1975 | Loe | 273/378 |
| 3,899,175 | A * | 8/1975 | Loe | 273/378 |
| 4,810,561 | A * | 3/1989 | King | 428/195.1 |
| 4,921,256 | A * | 5/1990 | Gearhart | 273/378 |
| 5,186,468 | A * | 2/1993 | Davies | 273/378 |
| 5,188,371 | A * | 2/1993 | Edwards | 273/378 |
| 5,275,890 | A * | 1/1994 | Wolf et al. | 428/514 |
| 5,501,467 | A * | 3/1996 | Kandel | 273/378 |
| 5,580,063 | A * | 12/1996 | Edwards | 273/378 |
| 6,019,375 | A * | 2/2000 | West, Jr. | 273/378 |
| 7,631,877 | B2 * | 12/2009 | Zara | 273/378 |
| 2007/0046760 | A1 * | 3/2007 | Zara | 347/105 |
| 2008/0054570 | A1 * | 3/2008 | Potterfield et al. | 273/403 |
| 2009/0058008 | A1 * | 3/2009 | Baumgartner et al. | 273/408 |

* cited by examiner

*Primary Examiner* — Mark Graham
(74) *Attorney, Agent, or Firm* — William E. Noonan

(57) ABSTRACT

An impact marking ballistic target blank includes a substrate having a photoreflective colored ink applied thereto. The photoreflective colored ink is covered by a thin transparent film. An opaque monochromatic base print coat is coated onto the outer film surface to obscure the photoreflective colored ink. The blank is manufactured and sold to an end user who prints various custom target images in one or more colors or color combinations contrasting with the photoreflective colored ink on the forward surface of the target blank base print coat, either by hand or by means of a computer and related laser, ink jet or dot matrix printer, or by other suitable printing technology medium. The substrate of the impact making blank target blank may include pressure sensitive label stock, with labels that are removably attached to a backing sheet to facilitate removal of labels, after an image has been printed onto them. After the printed label is detached from the backing paper, it is ready to be applied to a target mounting assembly and used as a target.

20 Claims, 12 Drawing Sheets

IMPACT MARKING TARGET BLANK AND METHOD FOR MANUFACTURING, MARKETING AND USING SAME

RELATED APPLICATION

This application is a continuation in part of U.S. application Ser. No. 13/065,005, filed Mar. 11, 2011, which claims the benefit of U.S. Provisional Patent Application Ser. No. 61/398,878 filed Jul. 2, 2010.

FIELD OF THE INVENTION

This invention relates to an impact marking target blank that is manufactured and sold to an end user who can print a custom target on the blank at an extremely economical cost. More particularly, the target blank allows the end user to create an unlimited selection of custom graphic designs, incorporating a virtually endless variety of color combinations, and to print custom personalized target designs upon the forward surface of the blank utilizing a diverse variety of printing methods such as, but not limited to, ink jet, laser, dot matrix, and other printing devices available to the consumer.

BACKGROUND OF THE INVENTION

Various impact reflecting targets are available for firearms use. See my U.S. Pat. Nos. 5,188,371 and 5,580,063. Such ballistic targets allow sport shooters and marksmen to improve their visual sighting of a bullet's point of impact on the target and therefore their shooting accuracy and skill. Known impact marking targets typically employ a substrate that carries a layer of photoreflective ink having a highly visible color such as yellow or red. This photoreflective ink layer is covered by a thin film of plastic material, with a target image printed on the film. When a bullet or other projectile strikes the target, the impact produces a halo around the periphery of the impact area, which reveals the underlying photoreflective color and thus marks the point of impact.

Although conventional impact marking targets are very helpful to, and popular with shooters and marksmen, they do exhibit a number of limitations. Such targets are produced exclusively and in their entirety at a manufacturing facility by the target manufacturer. As a result, available impact reflecting targets employ a very limited number of color combinations and target designs. These finished and "ready to use" targets also tend to be fairly expensive. There are very few custom, novelty or individualistic target designs available from the target manufacturers because it is unduly costly and inefficient to manufacture, advertise and distribute designs having only a very small or limited customer demand. Likewise, it is inefficient and expensive for target manufacturers to maintain large inventories consisting of many different target designs and/or color schemes. Currently there is simply no opportunity for an individual to obtain a custom designed or personalized target design having an impact marking capability. This constitutes a serious disadvantage for both the consumer/end user and the manufacturer interested in selling targets to individuals in the market for such products.

SUMMARY OF THE INVENTION

I have determined that both target manufacturers and end users have the need for an impact marking target blank that is less costly than commercially available targets of this type, and that enables users to conveniently generate their own custom target designs featuring previously unheard of design configurations, and colors. To accomplish this, I have developed a method for manufacturing, marketing and using an impact marking target blank upon which the end user can conveniently print from a virtually unlimited choice of custom design target images using readily available computer software, a computer, or smart electronic device, and an associated printer. By having access to this technology and capability, the shooting public, law enforcement and the military realize considerable cost savings and are able to create highly personalized impact marking target designs for the shooting public, as well as special target designs that satisfy the need for strategic target formats required by law enforcement and the military. Such individualized target design capability has until now been unavailable.

This invention results from a realization that a versatile, low cost and commercially available impact marking target blank, which allows the end user/shooter to select, generate and use any of a virtually endless variety of custom target images is long overdue. I have discovered that this long felt need is addressed and solved by applying a monochromatic base print coat (which may comprise an existing print coat composition or a proprietary formulation) over the transparent film that covers the underlying photoreflective ink layer traditionally used in such targets. The monochromatic base print coat utilized for this purpose is also formulated to provide a receptive surface that will allow proper reception and setting of assorted print media available to the end user/consumer. In particular, the print coat must effectuate absorption and drying of various ink jet and dot matrix inks. The print coat must also allow the fusion of thermal laser toner powders as used in laser printers. The novel base print coat allows the end user to print a custom target image upon the impact marking target blank by using a personal computer or smart device, and associated printer, or by other manual imaging processes.

This invention results from the further realization that the impact marking target blank of this invention provides the manufacturer of impact marking targets with an entirely new line of products and heretofore unavailable source of customers for such products. The manufacturer can market the impact marking target blank to end users comprising shooting enthusiasts, law enforcement personnel and the military who desire to implement their own custom, personalized or otherwise individualized impact marking target designs. To date, the target design has always been applied by the manufacturer as an integrated and critical aspect of the overall manufacturing process that creates the impact marking target. The manufacturers of such targets have never previously manufactured a monochromatic target blank having impact marking capability for sale to end users who ultimately apply their own custom or personalized target designs to the blank. The present invention provides an entirely new line of product inventory and source of marketing revenues for the manufacturers of impact marking targets.

It is therefore an object of the present invention to provide a process for manufacturing, selling and using a versatile impact marking target blank that will allow individual sports shooters and marksmen to inexpensively produce effective impact marking targets incorporating an unlimited variety of custom and individualized designs and colors.

It is also an object of this invention to provide an impact marking target blank that allows the end user/shooter to conveniently produce his or her own personal custom target designs manually, by applying a freehand drawing techniques, utilizing standard marking devices such as, but not limited to colored markers, paints, crayons, artistic supplies and stencils.

It is a further object of this invention to facilitate the personal and custom printing of impact marking target blanks on standard traditional paper target formats, as well as on other types of printable medium, such as but not restricted to, pressure sensitive materials, and composite, or plastic materials.

It is a further object of this invention to enable an individual to use their home computer and printer to convert an impact marking target blank into a completed fully functional impact marking target featuring both professional quality and performance.

It is a further object of this invention to provide a versatile impact marking target blank that represents a new and commercially advantageous product and revenue source for target manufacturers, and which can be manufactured, inventoried and distributed in a highly efficient and cost effective manner.

It is yet a further object of this invention to provide an impact marking target blank that can be effectively produced, and subsequently sold at a reasonable cost to the end user by utilizing a new inventive, versatile and creative technology with significant cost savings.

It is yet a further object of this invention to provide an impact marking target blank that improves shooting accuracy by using discrete target zones which are of different, contrasting colors to respectively represent intended target zones in close proximity to prohibited target zones, all within the same target. As this time, there are no known impact marking targets capable of providing this desirable feature, due to the limiting factors inherent in the existing technology currently used to manufacture commercial impact marking targets.

It is a further object of this invention to provide an impact marking target blank that may be effectively marketed to and used universally by a variety of customers including, but not limited to sport shooters, military and law enforcement personnel and others.

This invention features an impact marking ballistic target blank and a method for manufacturing such a blank. The blank includes a substrate having forward and rearward surfaces. The forward surface carries a high visibility colored photoreflective ink thereon. A transparent plastic film layer is superposed over the substrate such that the photoreflective ink layer is interposed between the substrate and the film layer. An upper surface of the film layer carries a monochromatic base print coat that extends across the entire upper surface of the film layer to obscure the photoreflective ink layer and form the blank. The print coat is formulated to accommodate various print media such as ink and laser toner in one or more colors that contrast with the color of the print coat to provide a selected target design or image thereon and thereby form the completed target. The ink comprising the finished target design includes one or more colors that contrast with the photoreflective ink layer. Penetration of a projectile through the print coat produces a shock wave that causes the contrasting color ink of the target design and at least a portion of the underlying print coat to be removed from the film around the periphery at the location where the projectile penetrates the print coat. This exposes an area of the underlying photoreflective ink layer in a "halo" configuration larger than the penetration point of the projectile. As a result, the exposed photoreflective ink surrounds and effectively marks the point of projectile impact and penetration.

Multiple blanks may be packaged and sold to consumers who can then use appropriate software to print finished target designs on the blanks or labels die cut from the blanks using contrasting colored ink or toner from a laser printer, ink jet printer, dot matrix printer, etc. A virtually endless assortment of graphic custom designs and color combinations may be employed.

The present invention teaches a concise print coat protocol that is contrary to the conventional teachings employed for traditional print coat applications, which are not required to meet the multiple faceted specifications of the impact marking target blank disclosed herein. It is critical to this invention that the print coat not only obscure the underlying photoreflective layer, but also be receptive to various print media including ink jet and dot matrix inks as well as laser toner cartridges. An unexpected advantageous result was discovered but not anticipated, relating to the base print coat color pigment components. While developing the critical formulation of the print coat pigment chemical components, and also following a strict monitoring protocol of the Solid State Image Density specifications during the print coat application, it was possible to achieve a performance balanced parameter, which optimized both the block out characteristics of the print coat, but more importantly, it was discovered that the combination of print coat pigment components would meet the criteria for both ink jet liquid drying critical characteristics, and the necessity to allow the successful fusion of dry laser toners onto the surface of the formulated base print coat after the print coat had been applied to the outer surface of the impact marking target blank.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
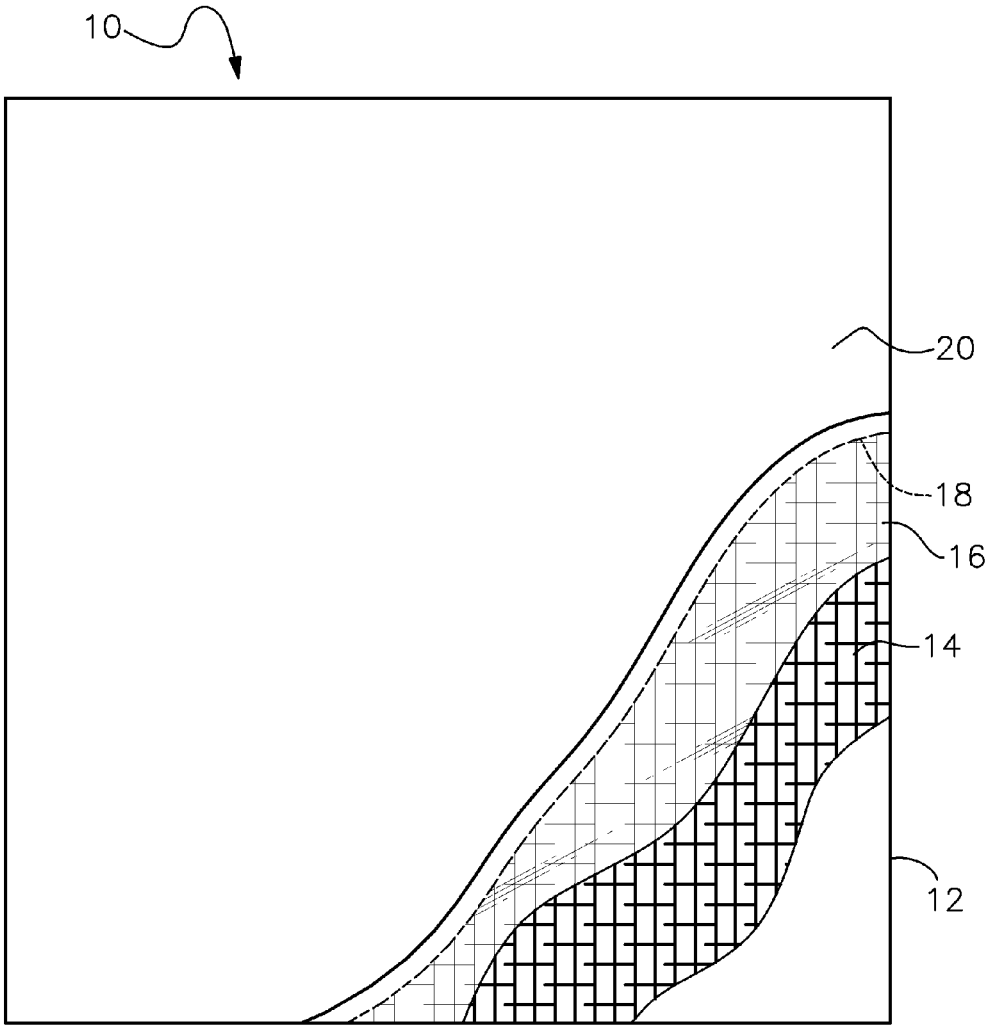
FIG. 1 is a front elevation view of an impact marking target blank of this invention. The blank is cut away to reveal the individual layers of the blank.

The new and novel embodiments described herein related to an impact marking target blank as well as to its manufacture, marketing and subsequent use. In particular, this product is uniquely adapted to be sold to end users and then interfaced with various known personal printing systems. In this disclosure are many novel and inventive embodiments which relate to the production, marketing and user of target blanks finished for use by sportsmen, law enforcement agencies, and the military in creating custom impact marking ballistic targets. As used herein "blank" refers to a sheet-like product featuring the impact marking technology disclosed herein and carrying a base print coat devoid of an image on its top surface.

The disclosed conceptual drawings may identify common reference numbers, and similar elements. The relative positions and scale of many elements are for the purpose of reference only, and are not intended to be for any other purposes other than to convey an understanding of function. Certain elements may be arbitrarily enlarged to convey their function and provide ease of recognition. Due to the repetitive use of some descriptive elements, nomenclature abbreviations may have been substituted from time to time in the interest of brevity.

This invention features an impact marking target blank, with a blank printable outer surface devoid of a printed graphic target image. The end user converts the impact marking target blank to a finished, fully functioning imaged impact marking target, after the end user prints a selected or custom graphic target image design upon a print coat applied to the outer surface of the impact marking target blank.

The impact marking target blank includes a substrate having forward and rearward surfaces. The substrate has a forward surface that carries a highly visible, colored photoreflective ink thereon. An optically transparent plastic film layer is superposed over the substrate such that the photoreflective ink layer is interposed between the substrate and the film layer. The upper surface of the film layer carries a monochromatic base print coat layer that extends across the entire upper surface of the film layer. The print coat layer has a solid image density adequate to obscure the photoreflective ink layer and form a blank target blank finished outer surface, which is capable of accepting a printed graphic image thereon. The print coat is designed to either absorb solvent or water based ink or allow the fusion of laser powdered toners in one or more colors, which contrast with the color of the print coat. This enables a graphic target image design to be printed upon the monochromatic outer surface thereby forming a completed, ready to use impact marking target.

The ink or toner comprising the target image design can include one or a multiplicity of colors that generally contrast with the photoreflective ink layer of the substrate. Penetration or impact of a projectile through the image formed on the print coat of the target produces a shock wave that causes particles of the print coat and target image printed thereon to be detached and displaced from the transparent film around the periphery at the location where the projectile impacts or penetrates the print coat. This exposes an area of the underlying photoreflective ink layer in a "halo" configuration which is larger than the penetration or impact point diameter of the projectile. As a result, the exposed photoreflective ink visible through the transparent film effectively marks the point of projectile impact and/or penetration.

In a preferred embodiment, the substrate may include a paper stock, which may have various weights and thicknesses to provide rigidity and which has the ability to be printed upon by conventional computer printers such as those that employ ink jet, dot matrix or laser printing technology. The substrate preferably has a nominal brightness of approximately 94 ISO, which is an international standard calibration scale used in the paper stock trade to quantify the whiteness and reflectivity of the substrate. A 24 pound 90 m/m2 paper stock calibrated in accordance with paper industry standards, as prescribed by TAPPI-T-500, SCAN P7, DIN 53105, ISO 534, is satisfactory as a substrate base, but the substrate is not limited to that specification. Alternative synthetic printable medium may be substitute for the paper substrate.

The photoreflective ink layer, which is preferably but not necessarily monochromatic, may be applied by flood tinting the substrate with a suitable high visibility photoreflective color such as, but not limited to, fluorescent yellow, red, and other highly visible photoreflective colors which may be employed. To ensure that the reflectivity of the high visibility photoreflective tinting upon the substrate is satisfactory, a specification is established according to the actual color that is selected. The specification is determined by the use of a densitometer reading, which is calibrated according to the solid image density scale (S.I.D), a recognized standard of measurement. For example, a desirable yellow high visibility photoreflective tinting may require, but is not limited to, a nominal reading of S.I.D. 120-140, depending upon the pigment granular density of the color selected.

The transparent film layer laminate may include optically transparent bi-axially oriented polypropylene, Mylar, or other similar materials. The film layer is typically laminated to the entire forward surface of the substrate. As a result, the optically transparent film layer laminate effectively acts as a window and permits the printed monochromatic photoreflective ink color applied to the forward surface of the substrate, to appear in full view through the overlying film layer.

The monochromatic base print coat may be custom formulated and is typically, but not restricted to, white in color. The monochromatic print coat may be flood coated onto the entire forward surface of the transparent film laminate. This completely obscures the highly visible fluorescent photoreflective ink layer that is interposed between the transparent film and the substrate. The monochromatic base print coat obscures the underlying photoreflective ink layer, and until such time that a projectile penetrates, or impacts the base print coating, the photoreflective color remains obscured.

The print coat is formulated to effectively absorb low and high viscosity liquid inks, and laser printer thermal toners, for which heat fusion required. In view of the diverse types of printers which may used to print the target design image thereon, it is of paramount importance that the print coat be compatible with a wide variety of printers such as, but not limited to, ink jet, dot matrix, laser, and other conventional printers and printing media, any of which may be employed to print graphic target designs on the surface of the impact marking target blank.

The contrasting color target graphic design ink or toner, can be applied to the impact marking target blank base print coating to achieve a virtually unlimited variety of designs. In particular, custom target graphic designs may be achieved on the users personal computer or on other computer systems using various commercially available graphic design programs. Designs may incorporate an unlimited number of colors and color combinations, which were heretofore unavailable, even on commercially available impact marking targets, due to the cost factor. As used herein, "ink" should be construed broadly to encompass various forms of colored substances and materials for forming a target design image. These may also comprise chalk, crayons, pencils, paints and other means, for manually applying the contrasting color target design onto the impact marking target blank base print coat.

An optional release agent may be interposed between the film layer and the print coat to facilitate removal of the print coat and printed target design, after penetration or impact of the target blank by a projectile. An optically transparent varnish or similar commercially available product is adequate for this purpose. The optional release agent may also be used as a means to modify the halo effect by reducing, or enhancing the impact dispersion of print coat particles. This will regulate the displaced ink particle halo size, thereby compensating for manufacturing variances, so that the underlying photoreflective ink surrounding the impact point will present the optimal halo visibility for the marksman down range.

This invention also features a business method of manufacturing and marketing an impact marking custom design target blank. An underlying photoreflective color layer is applied to a forward surface of a substrate. A transparent film is superimposed over the photoreflective layer and an opaque, monochromatic base print coat is applied over the film layer to block the underlying photoreflective layer. As previously described, a release agent may be optionally applied between the film layer and the monochromatic print coat. This produces an impact marking target blank that may be efficiently packaged and sold to end users at a reasonable cost, and which will provide a novel platform on which purchasers and/or end users can print or otherwise apply target designs of unparalleled complexity and unlimited colors. In addition, software for creating various graphic target designs, may be provided with the impact marking target blank. Such software may be either suitable for use as is, or compliant for modification by the end user.

The end user may utilize their own personal computer and printer with appropriate software to print preferred custom designs upon the impact marking target blank. The base print coat acts to absorb or otherwise accommodate a contrasting color ink, or other printing media, from the user's printer to form the custom target design. After a graphic image has been printed onto the top surface of the impact marking blank target blank, the impact marking target blank is considered to have been converted into a fully functional impact marking target.

The substrate may also consist of a pressure sensitive label stock to which a monochromatic photoreflective layer, a transparent film layer, an optional release agent and a print coat may be applied in the manner previously described. The rear surface of the substrate may include an adhesively attached label backing sheet. A number of individually die cut target(s) outlines, of a virtually unlimited variety of shapes and sizes, may be formed by die cutting through the substrate, but not the backing sheet to which the substrate is adhesively attached. In this format, each die cut label comprises individual impact marking target blanks that are removably mounted upon the common backing sheet. This variation would be available as an impact marking target blank label sheet to the end user, who can then use appropriate software to design and print graphic designs on the impact marking target label blank label sheet using contrasting colored ink or toner from a laser printer, ink jet printer, dot matrix printer, etc. A virtually endless assortment of graphic custom designs and color combinations may be employed.

To manufacture the target labels, impact marking, target blank production master sheet, would be produced, as previously described, but utilizing pressure sensitive label stock material. To create a detachable label, the master sheet is die cut through the monochromatic print coat, film and substrate without cutting into the common label backing adhesively attached to the rearward surface of the substrate. The shape of the die cut outline for the target label blank is frequently round, oval, or square, and may even depict the profile of wild game animal potential targets. The choice of a die cut shape outline is unlimited.

After the die cutting stage, the target blank master sheet carries a plurality of target blank labels with respective die cut outlines, which have not yet been printed with a custom target design image. The user obtains one or more sheets of impact marking target blank labels in this form, and then uses their own computer and printer, equipped with appropriate software, to print selected custom designs on the individual labels of the impact marking target blank sheet. Commercially available computer software is used to register the target image and color desired with the outline of the die cut blank forward surface of the pressure sensitive label stock. This allows the end user to generate their own custom printed impact marking target labels. The variety of target designs and choice of multiple color combinations are unlimited. The printed die cut label is detached, as needed, from the pressure sensitive backing sheet and is then attached to a desired target mounting surface (i.e. wall, holder, etc.) for use in target practice. The pressure sensitive label backing sheet is discarded after all the printed die cut labels have been removed.

In addition, this invention allows the end user to manually place a freehand drawn image or graphic design directly onto the surface of an impact marking target blank, be it either paper stock, or pressure sensitive label media, without using either a computer, or computer printer. The image may be manually drawn onto the top surface of the impact marking target blank by utilizing readily available color pens, crayons, markers, chalk, or other drawing instruments.

Once the hand drawn graphic design has been applied to the outer surface of the impact marking target blank, it will be ready for use as a fully operational impact marking target. By allowing the end user to utilize the impact marking target blank as a canvas to manually and artistically produce a finished graphic target design of their own choosing, regardless of the subject matter or artistic complexity, represents an option which is previously unheard of in the target industry, and heretofore not available for the users of projectile impact marking targets.

There is shown in FIG. 1 an impact marking target blank 10 that is intended for use by marksmen, law enforcement/military personnel, and shooters of virtually all types for firearms and other ballistic type devices, for target practice. Blank 10 employs an impact marking technology wherein an underlying photoreflective ink is exposed in a ring or "halo" form when the projectile strikes the target, to clearly indicate the precise point of impact. Such technology is disclosed, for example, in my U.S. Pat. Nos. 5,188,371 and 5,580,063, the description of which is incorporated herein by reference. The present invention uniquely applies an opaque monochromatic print coat over the forward surface of the transparent film in order to produce a blank that the manufacturer may commercially market and distribute to end users and that allows the end user to create a selected custom target image using his or her own personal computer, or smart device, and a printer.

Target 10 includes a bottom sheet-like substrate 12 that preferably comprises a paper stock having various weights and thicknesses suited to provide rigidity and capable of being processed by computer printers employing either ink jet, laser, or dot matrix technology. The paper defining substrate 12 typically has a paper stock weight of approximately 24 pounds and a brightness of, but not restricted to 94, although these specifications may be varied within the scope of this invention. It should also be understood that various other types of non-paper material may be used for the substrate. For example, it is possible to utilize either flexible, rigid, or transparent plastic, or other types of printable synthetic medium, providing the medium selected is processed consistent with the teachings contained herein.

A high visibility, monochromatic photoreflective colored ink layer 14 is printed or otherwise applied in a conventional manner to the front or upper surface of substrate 12. Layer 14 preferably comprises fluorescent yellow ink, although other high visibility, photoreflective ink colors such as red may alternatively be utilized. As used herein, "photoreflective" should be construed broadly to include any ink color that contrasts with and is visually distinguishable from the ink that forms the eventual target design. The ink may also contain an ultraviolet responsive pigment to facilitate a projectile impact halo sighting under low level lighting conditions. Substrate 12 may be flood tinted by ink layer 14, which may extend across the entire upper surface of substrate 12. Alternatively, as described more fully below, only a centralized or other selected portion of the substrate may carry photoreflective ink layer 14 so that projectile impacts that miss the intended target image and are, for example, proximate the outer edge of the substrate do not produce the photoreflective impact indication that is provided when the projectile accurately strikes the intended area of the target under which the photoreflective ink is printed.

A thin, optically transparent film layer 16 is applied over and adhered to ink layer 14. Film 16 preferably includes a transparent strip of bi-axially oriented polypropylene or similar plastic film having a pressure sensitive rubber or acrylic base adhesive backing. Other plastic films such as polyethylene, poly acrylic, Mylar and similar films may be substituted for polypropylene. Because laminated film layer 16 is optically transparent, it serves as a window and allows the photoreflective ink layer 14 to be exposed through film layer 16. The film layer locks the underlying ink layer in place on substrate 12.

An optional release agent 18 may be applied over film layer 16 as further described in U.S. Pat. No. 5,580,063. In various embodiments of this invention, the release layer may be omitted. The use of an optional additional release agent 18 provides a means whereby the size of the halo produced by a projectile impact can be increased, or decreased in size to compensate for manufacturing tolerances, thereby maintaining uniformity in performance and producing consistent results.

An opaque monochromatic base print coat 20, which may comprise a layer of white or alternatively monochromatic colored ink, is flood coated onto the entire top or front surface of film layer 16 and optionally interposed release agent 18. Print coat 20 features a highly pigmented ink and is formulated so that it visually obscures the underlying photoreflective layer 14. Print coat 20 should also readily absorb both high and low viscosity target image inks (as described below) and be receptive to the application of ink jet and impact dot matrix printer generic inks, as well as laser printer toners.

Figure 2:
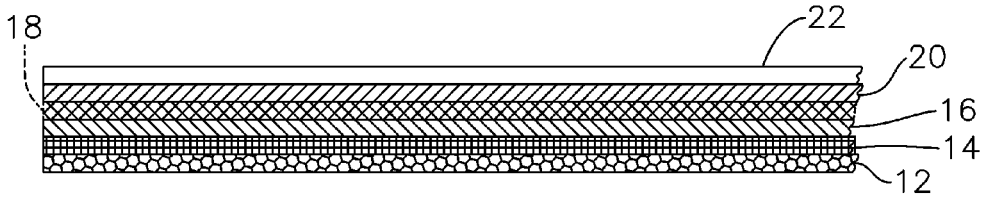
FIG. 2 is a fragmentary cross sectional view of the impact marking target blank and particularly depicting the layers thereof.

Although the impact marking target blank of this invention employs an underlying photoreflective ink layer for providing projectile impact marking, as in U.S. Pat. Nos. 5,188,371 and 5,580,063, it significantly departs from the teaching of those patents by using a top or base print coat 20, which patent No. '063 explicitly teaches against using. In particular, top coat 20 allows a flat contrasting ink 22, FIG. 2, to be applied thereto rather than being applied directly over either the film layer 16 or release agent 18. As a result, print coat 20 uniquely allows the end user to successfully produce a custom target image 24, FIG. 1 *a*, using the user's personal computer and/or associated printer. This forms a completed target 510.

The base print coat 20 is typically a highly pigmented ink and is specifically formulated to provide superior blocking of the underlying photoreflective ink. The base print coat is formulated for ink jet and dot matrix inks, and is further formulated to ensure a receptive surface on which to provide a stable platform to receive the imaging mediums of both ink jet and dot matrix printer inks, which dry (and are thereby rendered permanent) by a combination of absorption and evaporation on the surface of the print coat after the ink jet or dot matrix printer has printed the image on the surface of the print coat. The print coat formulation is additionally modified to accept laser printer imaging toners, which are fused (and thereby rendered permanent) by the application of controlled heat produced by the laser printer during the completion of an imaging cycle.

Due to the differing process requirements of the respective printing mediums (e.g. ink jet, dot matrix ink, laser printer toner) that are accommodated by the print coat, it is necessary to precisely balance the mixture of various binders, solvents and color pigments comprising the base print coat. Such constituent chemicals are common components in standard, commercially available print coat products. The precise formulation of the print coat may be varied with the scope of this invention.

The solvent formulation used in the print coat may be adjusted to achieve a positive degree of print coat adhesion to the surface of the optically transparent film. The contact bond between the transparent film and the applied base print coat should be compensated for, to withstand final processing of the impact marking target blank through a printer, or otherwise. Because the base print coat is not permanently bonded to the surface of the transparent film and is not absorbed into the transparent film surface, the applied print coat can be displaced from the surface of the transparent film. The force generated by a ballistic projectile impact strike, displaces particles of the imaged base print coat around the periphery of the point of projectile impact and/or penetration, to create a visible marking halo which is substantially larger than the circumference of the projectile impact or penetration hole. This halo is readily visible to the marksman at great distances as the displaced print coat reveals the contrasting high visibility reflective color of the substrate through the transparent film at the location of the displaced print coat ink.

The print coat should have a block out density (opacity) that efficiently obscures the high visibility monochromatic photoreflective color coat printed onto the forward surface of the substrate. This opacity is determined not only by the density of the substrate photoreflective print color pigment used, but also by the measured density of the base print coat ink applied to the outer surface of the film. The thickness, and resultant solid image density of the applied base print coat, is calibrated by a densitometer. Measurement of the solid image density should have a nominal value of S.I.D. 1.5 to 3.00. However, the definitive degree of opacity required is determined by the cumulative S.I.D. measurement of the substrate base reflective color, interacting with the print coat solid image density, which must be co-related and compensated for by taking into account the S.I.D. specification of the selected high visibility photoreflective ink coating color that is used on the substrate. This is necessary as working S.I.D. specifications vary from color to color.

The final S.I.D. value is successfully achieved on the production printing press by actively monitoring S.I.D. readings during the final printing stage of the base print coat to attain a consistent and acceptable S.I.D. density reading of the print coat being applied. An acceptable solid image density reading (S.I.D.), which will meet the prescribed level of acceptability, is achieved by controlling the quantity of print coat ink applied to the film during the printing process to attain the required solid image density specification parameters and provide an optimal level of block out density sufficient to obscure the highly reflective color applied to the substrate. In conclusion, the optimal S.I.D specification must be adjusted to ambient conditions at any given location. A person skilled in the art of printing would be well accustomed to making compensatory adjustments to maintain a suitable S.I.D specification for a print job on hand by taking into account the type of printing press in use, the characteristics of the pigment components used in the ink manufacturer's products, the type of paper and film to be printed on, and the temperature and humidity conditions at the production venue. All of the aforementioned variables have a definite cumulative effect on the production and final quality of the printing process. A S.I.D. range of 1.50-3.00 densitometer reading constitutes a reliable operational standard of reference, commensurate with the numerous variables that would be encountered in a normal production printing environment.

The print coat should also be conducive to the rapid drying of the printed image. In particular, the print coat should support the evaporation and absorption of ink jet and dot matrix inks on the surface of the print coat without exhibiting excessive image degradation.

A surprising and unexpected result is achieved as a result of the need to produce a high solid ink density print coat of S.I.D. 1.50 or greater. Such a high print coat solid image density is contrary to the teachings of conventional printing procedures, which teach a substantially lower solid ink density reading for print coats. The prior art teaches that a high solid image density reading on a print coat (S.I.D. specification) can have a detrimental effect on the final image printed thereon, due to the propensity of the printing ink to exhibit a phenomena known in the trade as image bleeding, misting, tailing or scumming. These anomalies are primarily the result of ink absorbing into the print coat in an irregular manner with a substantial degradation of print image quality and definition.

The foregoing problem can be particularly acute in printing applications that involve, for example, high resolution and multicolor screen processes, high quality commercial images, such as color photographs, graphic designs, or text utilizing a very small size font. For example, bibles, dictionaries and other works are apt to employ a font size (a trade nomenclature defining a standard alphanumeric character size) that may be as small as 6 point. A smaller caliber type font produces an image vulnerable to distortion by image inking irregularities, due to its relatively small print size. The printed image can be degraded by excessive absorption of ink by the print coat in an uncontrolled manner. This situation can result from using a print coat comprised of multiple print coat ink layers to attain a high solid image density reading (S.I.D).

By utilizing a controlled high print coat solid image density specification. It has been discovered that such a print coat is unexpectedly compatible, not only with ink jet and dot matrix inks, but also the imaging toner utilized by laser printers which utilize imaging technology substantially different from that of printers incorporating water, or solvent based inks.

It was also discovered, but not expected, that the solid image density of the print coat within the specifications as taught in this invention not only produces quality ink jet and dot matrix images, but also allows laser printers to efficiently and permanently apply printed images with a high degree of quality equal to, or exceeding that provided by ink jet and dot matrix printers as used in accordance with this invention. This benefit is the result of laser technology which does not require the printing medium to dry by absorption or evaporation. Surprisingly, yet beneficially, the releasability of the print coat from the transparent film to indicate a projectile impact halo is not compromised after the final target image is processed and printed by either ink jet, dot matrix or laser printers, or variants of such devices.

Regardless of the type of printer utilized, the final control of image quality rests with the end user. The image quality may be adjusted using the printer's standard operating controls which are typically present on all machines regardless of type. This allows for user adjustment of the target image to achieve the optimal print quality output.

Figure 1A:
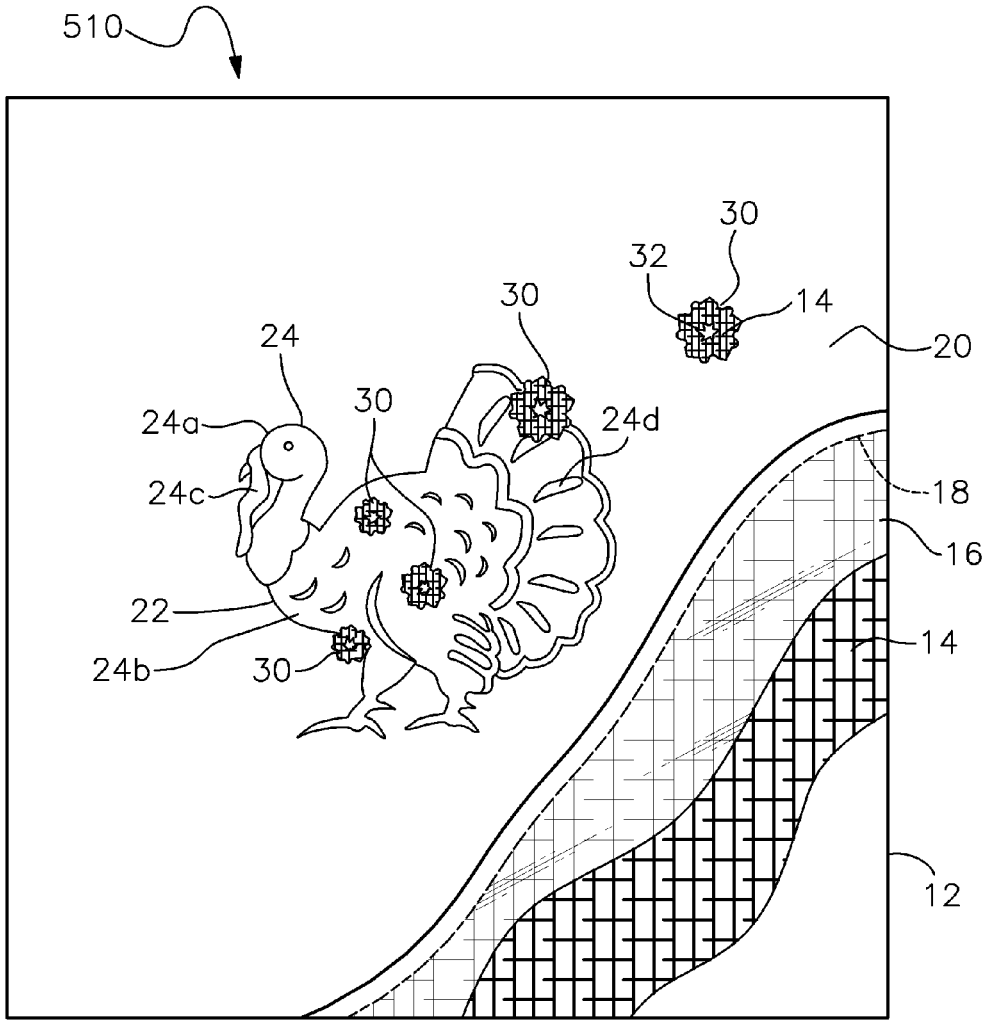
FIG. 1A is a front elevation view of an impact marking target blank in accordance with this invention, which has been converted into a finished impact marking target, and depicting a user applied, printed target image upon the outer surface of the blank. The target blank is cut away to reveal the individual layers of the impact marking target blank in accordance with an embodiment of the disclosure.

It should be understood that through the use of present technology color printers, target image 24, FIG. 1A, may comprise a wide and virtually unlimited variety of multiple colors and color combinations such as first color 24*a*, second color 24*b*, third color 24*c* and fourth color 24*d*. The target image may also comprise a single color ink in some versions. The types and combinations of colors that may be printed within each custom target image are not limitations of this invention.

Target 510, FIG. 1A, is mounted on a supportive surface, which may include a target holder, wall or virtually any other type of vertical support, and used in a conventional manner to provide highly visible and reliable indication of the point of projectile impact marking on the target. Specifically, the user shoots at the target, and the point of impact is clearly indicated by the halo 30 that forms around each bullet hole 32 in target 10. In particular, the projectile's impact causes both the ink 22 of target image 24 and the underlying print coat 20 to break away such that a halo or ring 30 having the color of the underlying photoreflective ink 14 is formed about each projectile penetration hole. The halo is formed in a manner analogous to that described in the previously referenced patents. In target 510, print coat 20 likewise breaks away such that bullet penetration halos 30 are formed around each point of impact.

Figure 3:
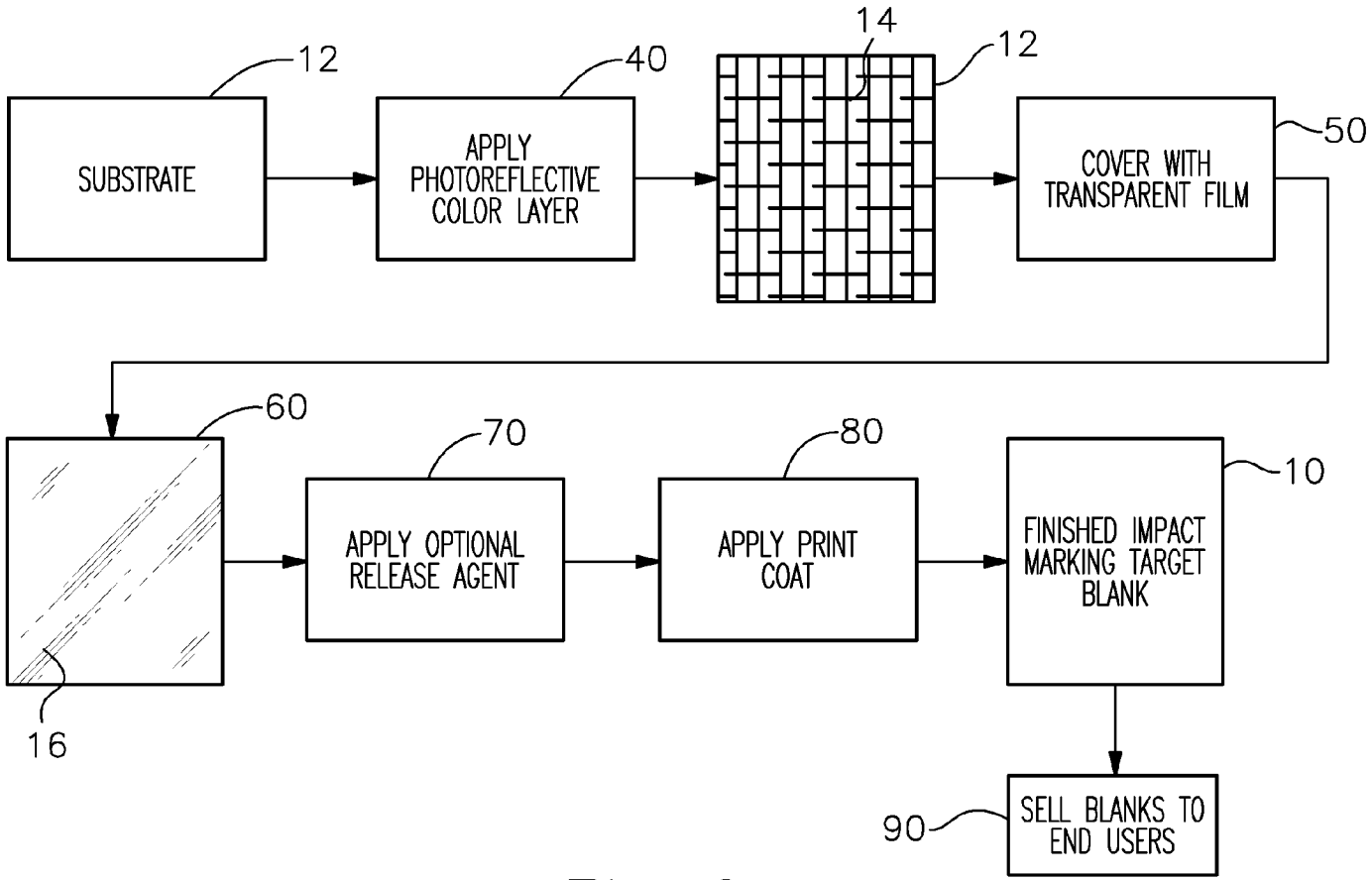
FIG. 3 is a block diagram of a preferred process for manufacturing and marketing the blank impact marking target blank.

FIG. 3 depicts a block diagram of the steps involved in manufacturing and marketing impact marking target blank 10 in accordance with this invention. In particular, the manufacturer applies a highly visible photoreflective ink, step 40, to the forward surface of substrate 12 to produce an underlying photoreflective ink layer 14 on the substrate. The manufacturer then covers ink layer 14 with a transparent film layer, step 50. This results in a partially completed target blank 60 wherein the underlying photoreflective ink layer (typically fluorescent yellow or red) is visible through transparent film layer 16. Release agent is then optionally applied over the film, step 70. Alternatively, release agent may be omitted. In either case, the manufacturer next applies a monochromatic base print coat, step 80, across the entire upper surface of partially completed blank 60. This blocks/obscures the photoreflective colored ink layer 14 and produces a finished impact marking target blank 10, which may appear as a white or alternatively colored, substantially monochromatic opaque sheet.

The foregoing steps are typically performed at a manufacturing facility. The manufacturer then packages a selected number of the finished blanks and markets those manufactured blanks to end users, step 90. This is a critical step in the overall process of manufacturing impact marking target blanks in a manner according to this invention. Conventionally, target images have been applied to an underlying substrate virtually simultaneously with a background ink layer. See, for example, Potterfield, US Publication No. 2008/0054570. In such cases, sophisticated industrial drying systems have been used to prevent the printing irregularities (e.g. image bleeding, misting, tailing and scumming) described above. Such industrial drying systems have been unavailable to the end user and, as a result, such end users have been heretofore unable to create their own specialty or custom impact marking targets. Instead, the only way amateur and professional shooters have been able to select their own target designs has been for them to upload the design to and/or order the design from the manufacturer's web server in a manner such as disclosed in Baumgartner, US Publication No. 2009/0058008. However, the targets disclosed by that reference are unrelated to impact marking target technology and employ no type of base or top print coat upon which a selected target image is printed. Moreover, the prior art teaches no capability for the end user to print his or her own selected design on target blanks sold by the manufacturer.

In the present invention, impact marking blanks manufactured in accordance with the previously described process and having a base print coat formulated as previously described are, for the first time, marketed and distributed by the manufacturer to end users. This provides the manufacturer with an entirely new product and revenue stream, which have heretofore been unavailable to target manufacturers.

Figure 3A:
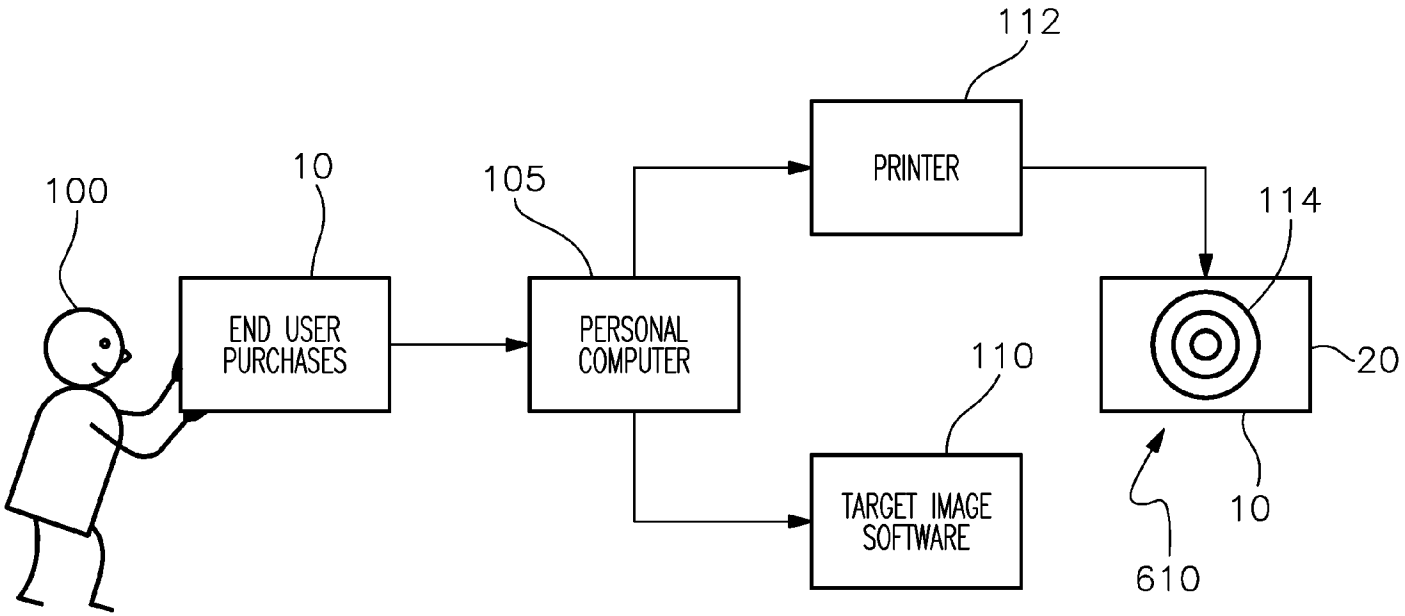
FIG. 3A is a block diagram of a preferred method wherein the end user processes and prints a target graphic image onto the surface of the impact marking target blank to form a finished target in accordance with this invention.

FIG. 3A illustrates an impact marking target blank 10 purchased by the end user 100. That person downloads and/or installs on his or her personal computer 105, appropriate software 110 (provided by the target manufacturer or otherwise) for generating a selected graphic image to print on blank 10. The image is then printed by the end user's printer 112 onto the front surface of the blank impact marking target blank, which converts the impact marking target blank to the status of a fully functional impact marking printed target 610 once a custom printed graphic image is printed thereon. The custom target image may consist of a traditional bull eye's target 114, as shown in FIG. 3A, or a custom target design of choice.

The base print coat 20 is again formulated and applied to have a high S.I.D. of preferably 1.5 or greater, which unexpectedly allows various print media readily available to the average end user, such as inkjet and dot matrix inks, as well as imaging toner, to be successfully applied in the form of image 114 to the blank and onto the base print coat without experiencing the previously described printing problems that would normally be expected when high S.I.D. ink specifications are employed. These types of print media are thereby capable of being applied to high S.I.D. print coats without requiring the use of expensive and complicated drying systems as are used in commercial operations. Such commercial applications, in any event, typically utilize much lower S.I.D. specifications than are involved in the present invention.

Through the use of various conventional graphic image printing programs, the end user is able to create a virtually endless variety of target images which employ a similarly unlimited variety of colors and color combinations. This provides the user with the ability to employ a far greater variety of target images than have been previously available from target manufacturers. It also allows the manufacturer to efficiently inventory and electronically distribute a far greater variety of target images than have been previously available from target manufacturers. For the first time, the manufacturer is empowered to efficiently produce and market a relatively inexpensive and generic target blank specifically designed to feature impact marking technology. Vast numbers of different designs do not have to be printed, inventoried and stored by the manufacturer in order to provide its customers with an access to wide assortment of possible images. This reduces manufacturing and storage costs considerably and provides the manufacturer with a versatile and previously unavailable product line. A heretofore unavailable source of revenue is also created for the manufacturer.

Figure 4:
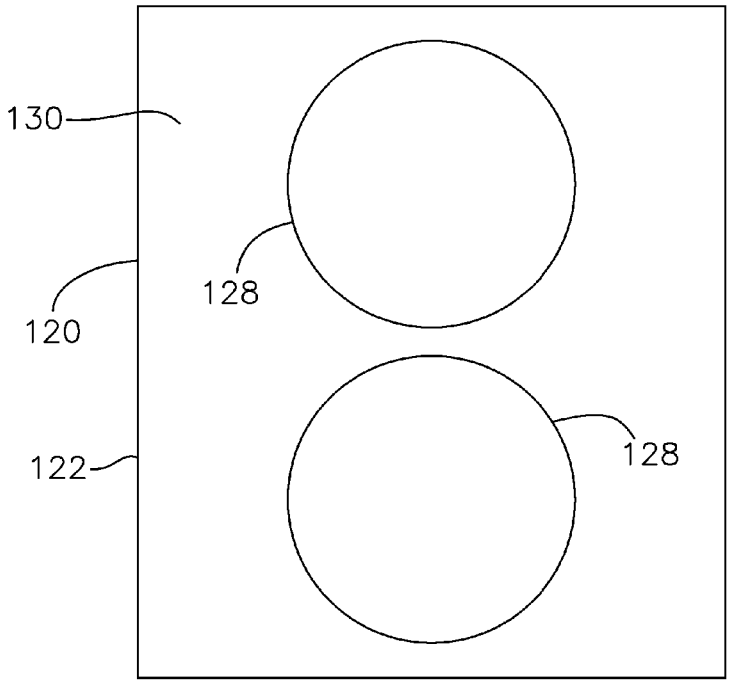
FIG. 4 is a front elevational view of a target blank sheet carrying a pair of adhesively backed blank labels upon which respective custom target images may be formed by the user in accordance with this invention.

FIG. 4, illustrates a sheet of pressure sensitive label stock 120 onto which a pair of circular die cuts are formed to produce target blank labels 128. In alternative embodiments, a virtually unlimited variety and number of shapes may be similarly die cut through the substrate. This operation is performed by cutting first through the base print coat 130, then through the transparent film and underlying photoreflective ink layer and the substrate itself. (not shown).

Figure 4A:
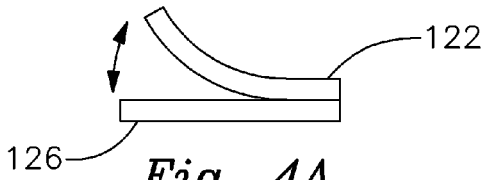
FIG. 4A is a fragmentary side view of a substrate comprising a substrate base and an adhesively interconnected backing sheet.

As shown in FIG. 4A, the die cut target label blanks 122 will remain on the surface of the pressure sensitive label backing sheet 126. At this juncture, no graphic image has been printed onto the surface of the target blank label.

After the labels have been die cut in the foregoing manner, the generic impact marking target blank 120 is ready to be marketed and distributed to the end user. That end user installs blank 120 into the selected printer, and prints a respective custom graphic target design onto each label 128 using appropriate software installed on a computer.

Figure 5:
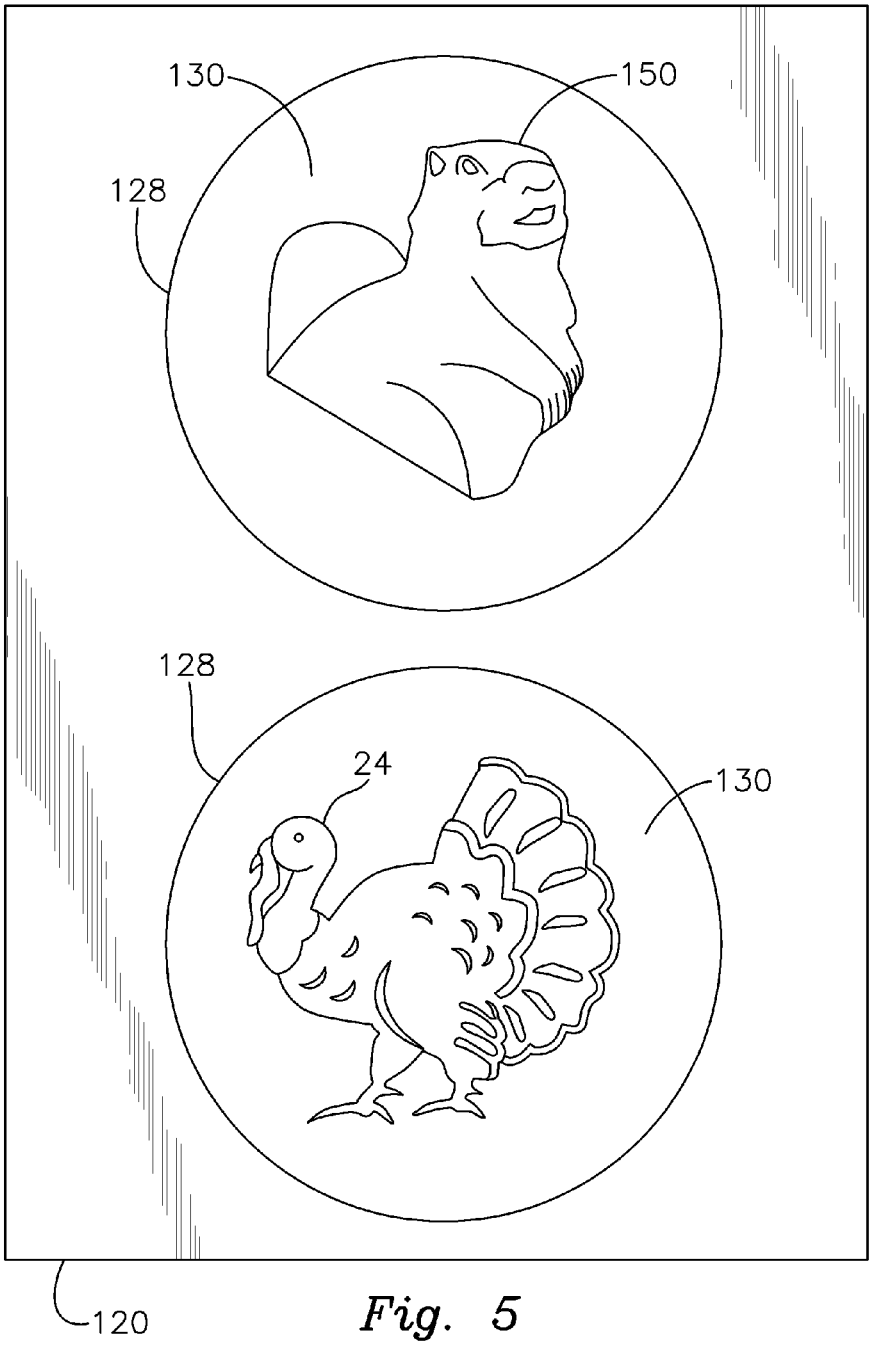
FIG. 5 is a front elevation view of the sheet shown in FIG. 4 after a pair of custom target images have been printed on the respective blank labels of the sheet.

As shown in FIG. 5, different customer target images for example 150 and 24 may be formed on respective labels 128. As previously described, each image comprises contrasting color ink or inks that are applied to and absorbed by top print coat 130. The images may include a wide assortment of graphic designs that the user wishes to employ as a target. By the same token, the images may include various colors and color combinations.

After the desired target image or images are printed onto the target blank 120, the individual labels 128 can be selectively detached from underlying backing sheet 126 by simply peeling each label from the backing. The labels are then applied to a wall, target holder or other vertical support surface and used in the manner previously described to mark each projectile's point of impact during target practice. The substrate backing 126 is not cut by the cutting die and remains intact. The backing 126 can be discarded after all printed target labels 128 on the backing sheet 126 have been removed for use.

In still other embodiments of this invention, the single target substrate 12 shown in FIG. 1 may be replaced by a sheet of pressure sensitive label stock analogous to sheet 122 shown in FIGS. 4 and 4A. In such cases, the end user is allowed to employ the entire upper print coat surface of the blank for applying a single or multiple custom target images thereto. Individual target blank sheets may be manufactured in accordance with the previously described process and sold to end users. The user then prints a selected custom target image onto the upper print coat surface such that the assembled sheet defines a single target label. This label is then used by simply peeling it from the removable adhesive backing 126, as previously described, and applying the label to a supportive surface so that the user is able to shoot at the supported target label.

Figure 6:
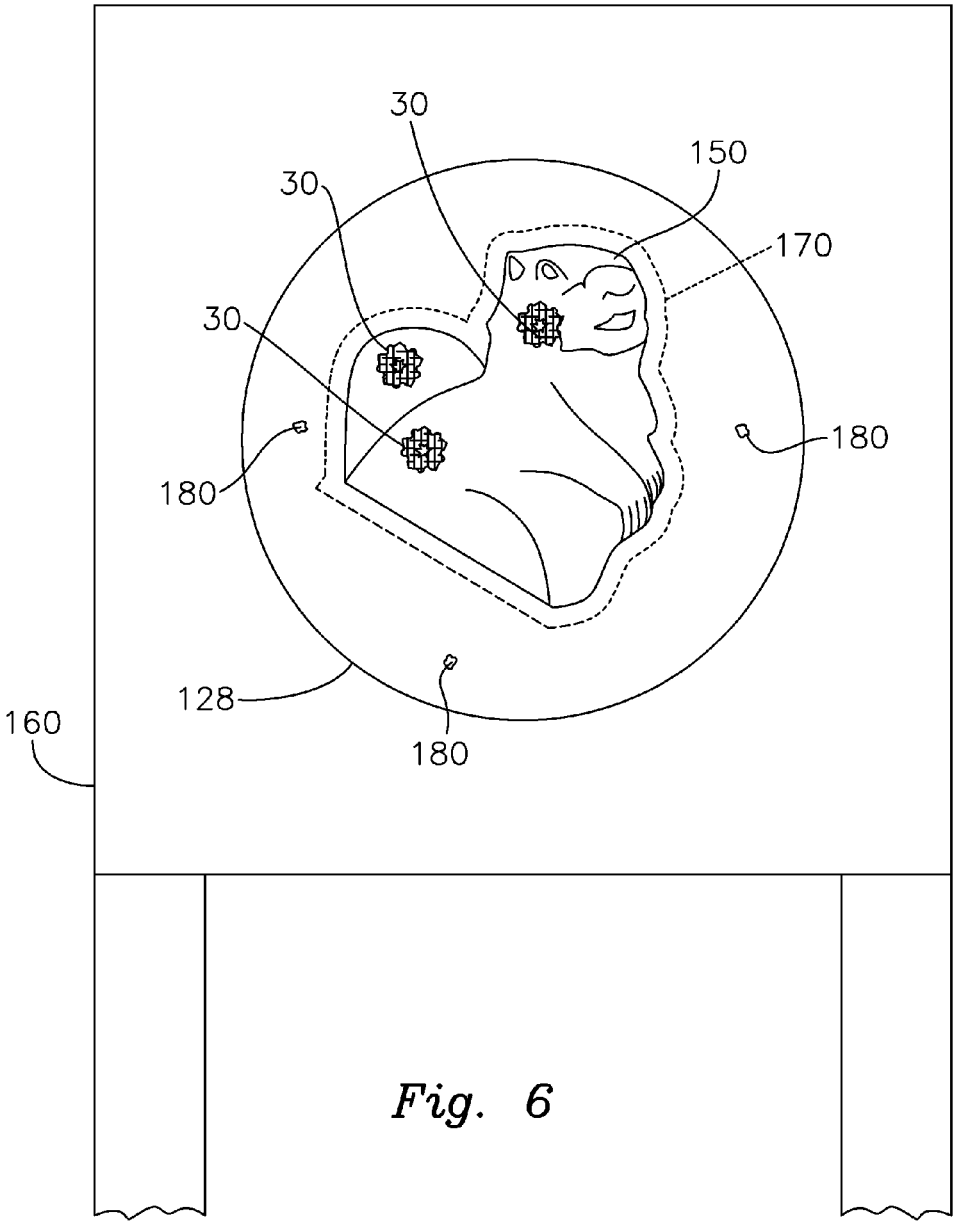
FIG. 6 is a front elevational view of a label removed from the sheet of FIG. 5 and applied to a target support structure; the photoreflective ink is applied only to a central portion of the substrate so that shots totally missing and distant from the target image do not provide photoreflective impact indication.

FIG. 6 depicts the upper target label 128 of FIG. 5 applied adhesively to a target support 160 (which may also be a wall or other vertical support). In this version, the impact marking target label 128 is manufactured to clearly differentiate between direct hits upon target image 150 and near misses. Instead of applying the underlying photoreflective ink across the entire substrate, such ink is applied only over a limited, central region 170 of the substrate. As a result, when a projectile impacts the target, a halo having the photoreflective color is produced only when the projectile strikes within the central region 170 or otherwise makes a direct or acceptable hit with the area defined by underlying photoreflective ink. When the projectile impacts areas of the target or target label outside of the central region 170 (for example at impact points 180), there is no halo effect produced because there is no underlying photoreflective ink layer at these locations. It should be understood that region 170 may be configured in various alternative ways (such as by directly conforming to the targeted image 150) in order to delineate selected intended/approved and prohibited target zones. Only target projectile impacts in the approved or intended target zones delineated by the underlying photoreflective ink layer produce impact indicating halos. This feature is particularly effective for use in military and law enforcement training wherein the immediate and accurate determination of whether or not a shot has impacted or missed an intended target is of critical importance. Near misses are clearly identified by the lack of an impact halo.

Figure 7:
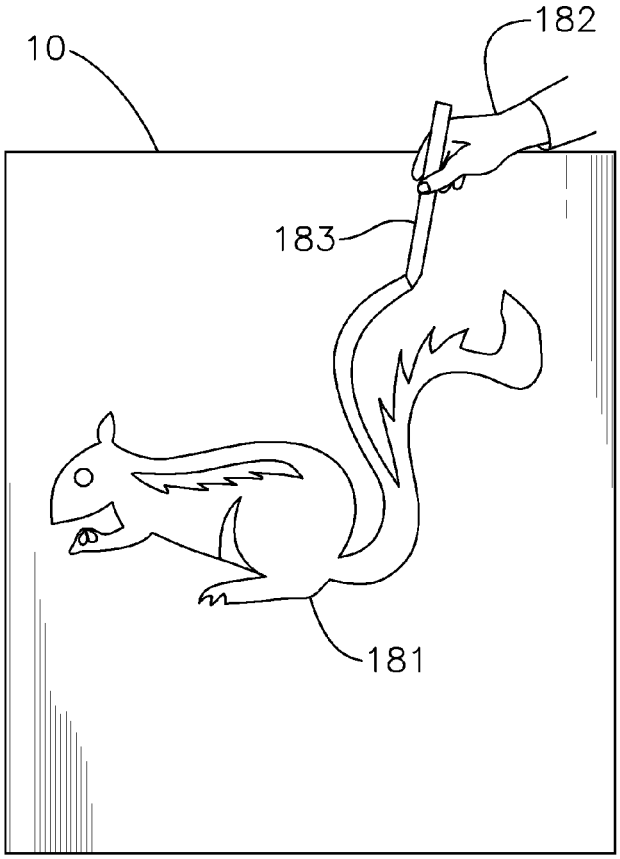
FIG. 7 is front elevational view of a target blank, in accordance with this invention, showing the depiction of a person's hand using a utility marking pen to manually draw a custom, freehand target design upon the base monochromatic print coated outer surface of the target blank.

FIG. 7 Illustrates a target image 181 being manually drawn by hand 182 onto the surface of an impact marking target blank 10 (manufactured as previously described) using a hand held drawing instrument 183, which could take the form of a pencil, crayon, ink marker, or other common drawing instrument. This capability to manually draft a target image gives the target user an opportunity for personal self expression and creativity. There is no limit to the type of design that may be manually drafted, or the number of color combinations selected. This feature provides a heretofore unheard of user option in the existing impact marking target industry.

Figure 8:
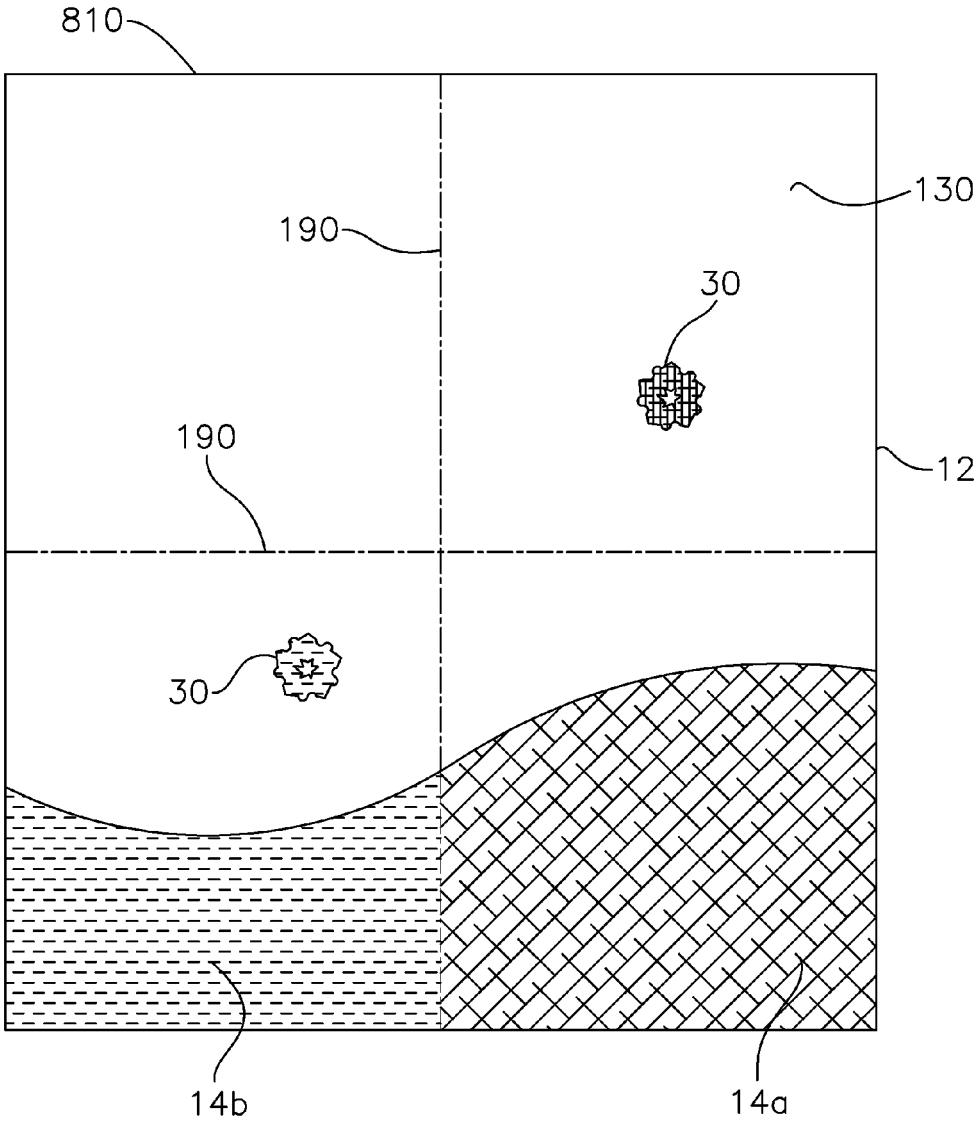
FIG. 8 is a front elevational view of the target substrate, which is divided into a plurality of quadrants to allow multiple different photoreflective colors to be applied to the substrate; also depicted is a reference alignment grid pre-printed on the forward surface of the print coat to facilitate graphic image placement and location of the obscured quadrant outlines for the end user's convenience.

FIG. 8 shows yet another blank impact marking target blank 810 which extends the creative possibilities of this invention by including an impact marking target blank substrate carrying two or more substrate photoreflective ink colors such as, but not limited to, yellow 14*a*, and red 14*b*. The photoreflective quadrants are shown as, but not limited to, two oblong quadrant configurations. Not only does this version expand artistic and creative design in that multiple color impact halo's are presented, it also allows co-operative sharing of a single target by multiple marksmen, as clearly delineated by the color of the impacted halo 30. FIG. 8 depicts the substrate base 12, and photoreflective ink coats 14*a*, and 14*b* and base print coat 130. FIG. 8 also illustrates a placement calibration guide comprising a reference alignment grid 190 to enable an accurate placement of graphics to be printed on the outer surface of the impact marking target blank. The grid 190 is pre-printed onto the outer surface of the target blank base print coat 130 using a low density neutral color, and reduced print line size to ensure it is unobtrusive at normal shooting range distances.

Although the quadrant grid 190 may include additional graphic image placement calibration guides, the primary function of the grid 190, is to provide a visible outline corresponding to the perimeter outline of the individual visually obscured photoreflective quadrants printed upon the surface of the substrate. It is also a requisite that the quadrant grid markings be visually unobtrusive to the marksman stationed at his firing position.

Figure 9:
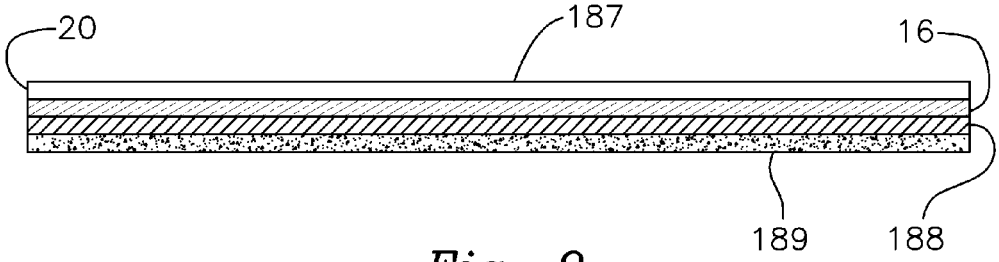
FIG. 9 is a fragmentary cross sectional view of the impact marking target blank and particularly depicting the layers of the film blank.
Figure 11:
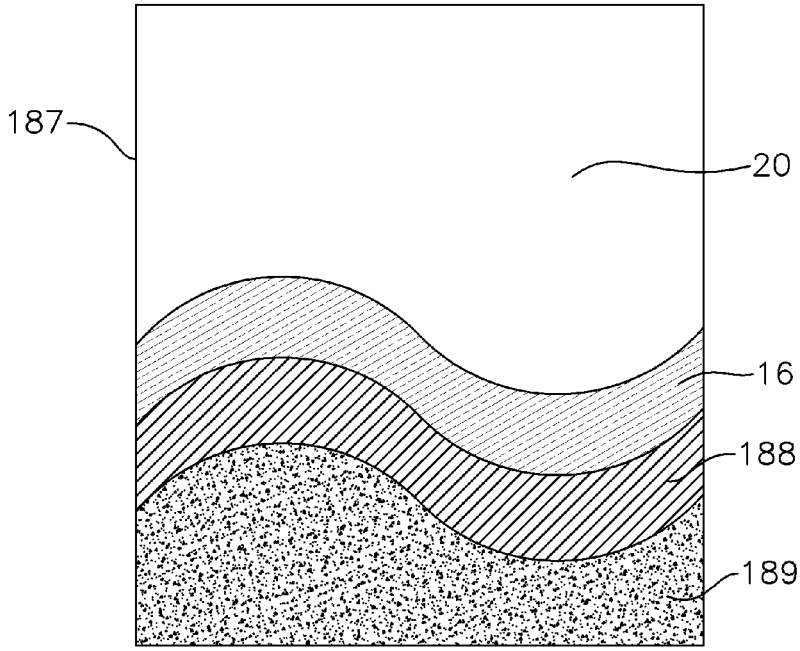
FIG. 11 is a front elevation view of an impact marking target film blank of this invention. The blank is cut away to reveal the individual layers of the impact marking target blank in accordance with an embodiment of the disclosure.
Figure 10:
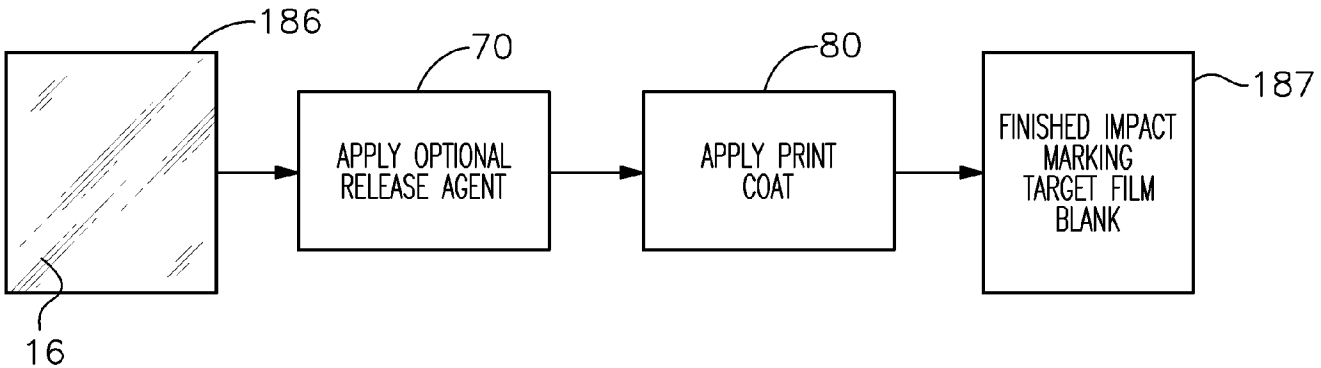
FIG. 10 is a block diagram of a preferred process for manufacturing a marking target film blank in accordance with an embodiment of the disclosure.

FIGS. 9-11 illustrate an additional embodiment as described below. Attention is directed to the novel and unexpected benefits resulting from the total elimination of the base substrate, and the associated photoreflective color during the manufacturing cycle. Both of the aforementioned elements are completely eliminated from the manufacturing process of the impact marking target blank film blank. As shown in FIGS. 9 and 11, the elements of the impact marking target blank film blank consist of the disposable backing paper 189, the transparent film 16, which is detachably affixed to the forward surface of the disposable backing paper by a removable adhesive 188. The monochromatic base print coat 20 is printed on to the forward surface of the transparent film 16 defining a finished impact marking target film blank 187.

The elimination of the impact marking target substrate during manufacturing of impact marking targets is unheard of in the industry, there is no precedent for such a protocol, and as such it presents a radical and unheard of departure from the established teachings of the target industry concerning ballistic impact marking technology.

The benefits resulting from removing the substrate from the impact marking target blank during the production process are apparent in FIG. 10. The need for a sheet of substrate material is eliminated, which provides an immediate cost savings. Manufacturing the impact marking target film blank in accordance with FIG. 10 also reduces the number of production stages required to produce the target label blank previously described. Facilitating the manufacturing process in this manner provides for improved efficiency and substantial cost savings.

Numerous other unexpected significant benefits and advantages will now become readily apparent as additional novel and inventive embodiments are further disclosed. In order to compensate for the omission of the substrate during the manufacturing of the impact marking target blanks as shown in FIG. 9, it is necessary to use a pressure sensitive film label stock 16, which supports an optically transparent film detachably mounted onto a pressure sensitive backing sheet 189. The transparent film 16, should have a nominal thickness, but is not limited to 0.002 mil. These specifications are consistent with prevailing standards for conventional pressure sensitive film stock. The optically transparent film itself, would be coated with a monochromatic base print coat 20 in a manner as disclosed by previous embodiments.

Figure 10A:
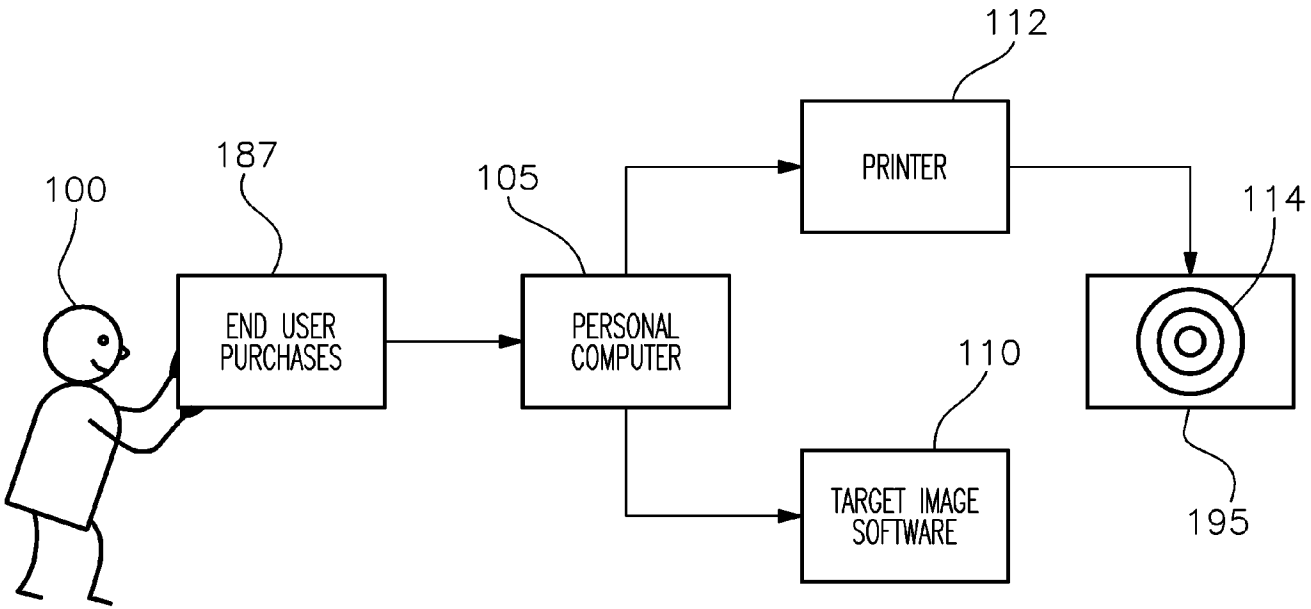
FIG. 10A is a block diagram of a preferred method wherein the end user processes and prints a target graphic image onto the surface of the impact marking target film blank to form a finished target in accordance with this invention.

After the impact marking target blank film blank has been manufactured it is packaged and sold to end users, step 191. As shown in FIG. 10A, the finished impact marking target film blank can then be imaged with the appropriate graphic target design chosen by the end user as previously disclosed. The end user creates a selected image by utilizing his or her own personal computer 105 programmed with selected target image software 110. The selected image is applied to film blank 187 by the printer 112 associated with personal computer 105 (or other smart device) and the accompanying printing media of choice (e.g. ink, laser toner). After the outer surface of the blank impact marking target film blank transparent sheet 187 has been printed with a graphic image by the end user, the imaged film 195 FIG. 10A, would be handled in the same manner as a pressure sensitive label. This requires that the imaged impact marking target film blank 187 be detached from backing sheet 189, FIG. 9, and then affixed to a suitable auxiliary backing sheet, or alternatively mounted onto a target support base, such as base 160 in FIG. 6.

There are numerous options open to the end user, which allow great freedom of artistic expression previously unavailable. The end user can select from an unlimited availability of suitable backing sheets, featuring both photoreflective coatings, or standard conventional colors, depending on personal preference, taking into account the type and characteristics of the printed graphic image rendered on the outer surface of the blank film. As the printed impact marking target film 195 has an optically transparent pressure sensitive adhesive attached to the rear surface, it may be detached from the backing sheet 189 and affixed to the selected substitute backing sheet, which replaces the substrate used in other previously described embodiments of this invention.

Optionally, an auxiliary support backing sheet of a suitable paper weight such as, but not limited to 24 lb, may be printed by the end user, on their own choice of backing media and printing equipment. This allows the end user unlimited creative freedom as regards the choice of photoreflective color, or design of an artistic motif, containing elements complimentary to the graphic design of the target image, such as a pattern of multi-colored photoreflective inks, which could also be comprised to create a graphic image. None of the aforementioned are available as a standard item from the target industry. When the selected impact marking target film blank backing sheet has been selected, it is necessary to print the graphics of choice onto the forward surface of the back up sheet using the printer of choice FIG. 10A. The end user then detaches the impact marking target blank film label from its label backing sheet and simply aligns and affixes the impact marking target film blank label directly to the front surface of the auxiliary backing sheet thereby completing the assembly of the impact marking target blank.

The impact marking target film blank label may also be left affixed to the label backing sheet 189 FIG. 9, for immediate shooting purposes. The label backing sheet 189 serves as an auxiliary substitute replacing the impact marking target blank substrate backing sheet 12 shown in FIG. 2. However, since standard label backing sheets are of a light weight paper stock, and generally white in color, this fact would have to be taken into account, as both the color, and possible lack of photoreflectivity properties, may result in a degraded impact marking contrast effect.

To have a die cut profile cut through the surface of the impact marking target film blank, is an option also available as illustrated in FIG. 5. Although the design as illustrated by label 128, FIG. 5, consists of a single animal conceptually depicted on, 24, 150, FIG. 5, various other embodiments may consist of actual photographs or many other varieties of graphic images to more realistically portray the target image of choice. In order to facilitate the use of a target film blank label, it may be affixed to an auxiliary back up sheet, or comply with other mounting alternatives as previously described.

When the impact marking target film blank remains affixed to the support backing paper or target support of choice, it will function in the identical manner as an impact marking target blank produced in accordance with, and by following the teachings of the previously described embodiments. The impact halo visibility performance, however, is dependant upon photoreflectivity. Performance may be affected to some degree by the choices of photoreflective or nonphotoreflective color selected by the end user and applied to the support backing paper or the target support backing element 160, FIG. 6.

The disclosed embodiments show that the present invention allows target manufacturers to efficiently produce reliable impact marking target blanks that permit the end user to select and print various target images of unlimited colors and color combinations. This invention provides a whole new technology product line for target manufacturers. At the same time, it provides significantly better target image variety and improved versatility for the end user. The impact marking target blank may be made available on both traditional paper formats and as a pressure sensitive adhesively-backed label. This technology allows marksmen and sports shooters of all types to produce and use a virtually unlimited variety of impact indicating targets, in an efficient and cost effective manner. The target blank is convenient for use by all types of persons engaged in target practice including, but not limited to, sports shooters, law enforcement and military personnel.

From the foregoing it may be seen that the apparatus of this invention provides for a impact marking target blank that clearly indicates, or marks the point of projectile penetration and, more particularly, to a target that allows the user to generate and shoot at an unlimited variety of custom target designs featuring a wide variety of colors and color combinations. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention. Accordingly, the disclosure is not limited except as by the appended claims.

What is claimed is:

1. An impact marking ballistic target blank comprising:

a substrate having forwardly and rearwardly facing surfaces, said forwardly facing surface carrying a high visibility photoreflective colored ink thereon;

a transparent film layer superposed on said forwardly facing surface of said substrate such that said photoreflective colored ink is interposed between said substrate and said film layer, said film layer having an upper surface facing forwardly of said substrate; and a monochromatic opaque print coat layer that contrasts in color with and is visually distinguishable from said photoreflective colored ink and that extends in a continuous, uninterrupted manner across the entire upper surface of said film layer, said print coat layer covering and obscuring the entire film layer and all of the photoreflective colored ink interposed between said substrate and said film layer such that said print coat defines across and in front of the entire forwardly facing surface of said substrate a monochromatic blank surface devoid of an image, said print coat layer having an S.I.D. of at least 1.5 and being receptive of ink jet and dot matrix inks and laser toners to form printed images thereon without accompanying image degradation including bleeding, misting, tailing or scumming.

2. The blank of claim 1 further including a release agent interposed between said film layer and said print coat layer to facilitate removal of portions of said print coat layer upon impact from a ballistic projectile.

3. The blank of claim 1 in which said substrate carries an adhesively attached backing sheet.

4. The blank of claim 3 in which said substrate, said photoreflective colored ink, said transparent film layer and said print coat layer are die cut to define multiple target labels that are adhesively attached to said backing sheet.

5. The blank of claim 1 in which said photoreflective colored ink extends across less than the entire forward-facing surface of said substrate to provide, upon impact from a ballistic projectile, for an impact marking halo effect only within a selected region of said blank that is smaller than said forwardly facing surface of said substrate.

6. The blank of claim 1 further including a placement calibration guide printed on an upper surface of said base print coat for visually dividing said monochromatic blank surface into multiple blank sections wherein an underlying photoreflective segment is obscured by a respective monochromatic portion of said base print coat layer.

7. The blank of claim 1 in which said print coat layer has an S.I.D. of not greater than 3.0.

8. An impact marking ballistic film blank comprising:

a transparent film layer having upper and lower surfaces; and an opaque monochromatic print coat layer that extends in an uninterrupted manner across said upper surface of said film layer to completely cover and obscure the entire film layer and defining a monochromatic film blank devoid of an image, said print coat layer being releasably attached to said film such that when a ballistic projectile impacts said film blank, a section of said print coat layer adjacent to a point of impact of the projectile is dislodged from said upper surface of said film layer, said print coat layer having an S.I.D. of at least 1.5 and being receptive of ink let and dot matrix inks and laser toners to form printed images thereon without accompanying degradation including image bleeding, misting, tailing or scumming.

9. The film blank of claim 8 in which said film layer is bounded by a peripheral edge and said print coat layer covers the entire upper surface of said film layer inside of said peripheral edge.

10. The blank of claim 8 further including an adhesive for securing said lower surface of said film layer to an underlying supportive surface that includes a color contrasting with the color of said print coat layer, said print coat layer being releasably attached to said film such that when a ballistic projectile impacts said film blank, a section of said print coat layer adjacent to a point of impact of the projectile is dislodged from said upper surface of said film layer to reveal the supportive surface underlying said film layer.

11. The blank of claim 8 in which said print coat layer has an S.I.D. of not greater than 3.0.

12. The film blank of claim 10 further including a film blank backing sheet adhesively and removably attached to said lower surface of said film layer by said adhesive, said film blank backing sheet being removed from said film layer for attaching said film blank to the supportive surface.

13. A method of manufacturing and marketing an impact marking ballistic target blank, said method comprising:

providing a substrate having forwardly and rearwardly facing surfaces;

applying a high visibility photoreflective colored ink layer to said forwardly facing surface of said substrate;

superimposing a transparent film layer over said photoreflective colored ink layer such that said photoreflective colored ink layer is interposed between said substrate and said film layer;

applying an opaque monochromatic, print medium absorbent print coat layer that contrasts in color with and is visually distinguishable from said photoreflective colored ink layer in a continuous uninterrupted manner across the entire upper surface of said film layer to completely cover and obscure said film layer and said photoreflective color ink layer in their entireties to provide an impact marking ballistic target blank wherein said print coat defines across and in front of the entire forwardly facing surface of said substrate an uninterrupted, monochromatic blank surface devoid of an image, said print coat layer having an S.I.D. of at least 1.5 and being receptive of ink jet and dot matrix inks and laser toners to form printed images thereon without accompanying degradation including image bleeding, misting, tailing or scumming; and marketing said blank to customers for forming a selected target design image on said blank.

14. The method of claim 13 further including the step of interposing a release agent between said film layer and said print coat layer to facilitate removal of portions of said print coat layer and said target design image formed thereon upon impact from a ballistic projectile.

15. The method of claim 13 in which a target design print medium comprises one of a computer printer ink and toner that is applied to said print coat layer by a computer operated printer.

16. The method of claim 15 further including the step of using a graphics generating computer program to direct said printer to apply said selected target design image to said print coat layer.

17. The method of claim 16 in which said blank is introduced into said printer and processed in accordance with said graphics generating computer program to print said selected target design image thereon.

18. The method of claim 13 in which a target design print medium has a color that contrasts with and is visually distinguishable from the color of said print coat.

19. The film blank of claim 13 further including providing said film layer with a peripheral edge that borders said film layer and applying said print coat layer to said film layer to cover the entire film layer inside of said peripheral edge.

20. The method of claim 13 further including the step of applying onto and covering an upper surface of said print coat layer a target design print medium that is separate and distinct from said print coat layer and in accordance with the selected target design image for support of said target design print medium by said print coat layer, said target design print medium having a color that contrasts with and is visually distinguishable from the color of said photoreflective colored ink layer.

* * * * *